United States Patent [19]

Altemir

[11] 4,378,546

[45] Mar. 29, 1983

[54] RELAY ARMATURE MOUNTING

[75] Inventor: Sebastian A. Altemir, Valls, Spain

[73] Assignee: Mecanismos Auxiliares Industriales S.A. Maisa, Valls, Spain

[21] Appl. No.: 235,565

[22] Filed: Feb. 12, 1981

[51] Int. Cl.[3] ..... H01F 7/08

[52] U.S. Cl. ..... 335/270; 335/276

[58] Field of Search ..... 335/270, 271, 274, 276, 335/279, 128

[56] References Cited

U.S. PATENT DOCUMENTS 3,317,871 5/1967 Adams ..... 335/276 X 4,045,755 8/1977 Schroeder ..... 335/276 X

FOREIGN PATENT DOCUMENTS 136157 2/1950 Australia ..... 335/276

*Primary Examiner*—George Harris

*Attorney, Agent, or Firm*—Michael J. Striker

[57] ABSTRACT

An armature for a relay has a stationary armature element with two arm portions extending substantially normal to one another, and a movable armature element which is arranged movable relative to the stationary armature element with the aid of a joint including a projection formed on one arm portion of the stationary armature element and having a predetermined trapeze-like cross section, and a groove formed in the movable armature element and having a cross section which is greater than the cross section of the projection of the arm portion of the stationary armature element. The groove of the movable armature element may be uninterrupted, or interrupted and formed by two pairs of protuberances. The projection and the groove may include two flanks inclined towards one another by different angles and connected with one another by a circular end section.

8 Claims, 4 Drawing Figures

RELAY ARMATURE MOUNTING

BACKGROUND OF THE INVENTION

The present invention relates to a relay, and more particularly to its armature.

The electronics industry is nowadays making important breakthroughs which require new systems and processes to be developed, as well as new mechanisms improving the performance of all components of these systems. A key item of the electronics industry are relays which are utilized in ever-increasing amounts. One of the requirements which is made of the relays is the necessity to increase both their performance and to improve all their characteristics. Especially important are measures which can reduce wear on the components of the relays so as to increase the service life and to attain better performance of the relays. It is known that one of the most important limiting factors in the known relays is the friction between the fixed armature element and the movable armature element during the operation of the relay. Problems arise from the above friction in a large number of relays, and the friction frequently causes complete failure. This is because the reliability of such relays is extremely limited as a result of the high mechanical resistance that the friction between the moving armature element and the fixed armature element offers during the operation of the relay.

SUMMARY OF THE INVENTION

Accordingly, it is an object of the present invention to provide an armature for a relay, which avoids the disadvantages of the prior art.

More particularly, it is an object of the present invention to provide an armature for a relay, in which the above-mentioned problems of wear because of the friction between the fixed armature element and the moving armature element is considerably reduced, whereby an increased performance and a considerable improvement in the operating conditions are attained.

In keeping with these objects, and with others which will become apparent hereinafter, one feature of the present invention resides, briefly stated, in an armature for a relay, in which a movable armature element is connected with a stationary armature element by a joint including a trapeze-like projection on an arm portion of the stationary armature element, and a groove which is formed in the movable armature element and has a cross-section somewhat exceeding the cross-section of the trapeze-like projection of the stationary armature element. When the armature is designed in accordance with the invention, it attains the above-mentioned objects.

In accordance with another advantageous features of the present invention, the inclined flanks of the cross-section of the projection of the stationary armature element are inclined to one another by an angle which is somewhat smaller than the angle between the inclined flanks of the groove of the movable armature element.

Still another advantageous feature of the present invention resides in the fact that the inclined flanks of the cross-section of the projection of the stationary armature are connected with one another by a circular end section replacing a sharp edge. In such a construction the movable armature element can perfectly rock on the projection of the stationary armature element.

The groove of the movable armature element may extend over the entire width of the latter and be formed as an uninterrupted groove. In contrast, the groove may be formed between two pairs of protuberances which are arranged so that the protuberances of each pair are spaced from one another in direction of elongation of the movable armature element, and the pairs of protuberances are spaced from one another in direction of the width of the movable armature element. Two grooves which are formed between two pairs of protuberances together form a combined groove which extends in direction of the width of the movable armature element and is interrupted.

Finally, a further feature of the present invention is a relay which is provided with the above-described armature.

The novel features which are considered as characteristic for the present invention are set forth in particular in the appended claims. The invention itself, however, both as to its construction and its method of operation, together with additional objects and advantages thereof, will be best understood from the following description of preferred embodiments when read in connection with the accompanying drawing.

DESCRIPTION OF THE PREFERRED EMBODIMENTS

Figure 1:
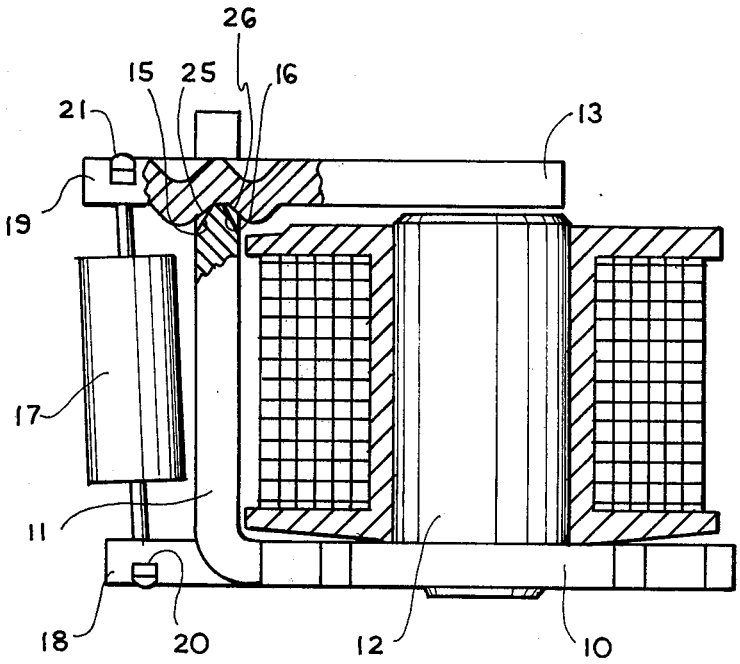
FIG. 1 is a side elevation view, partially sectioned, showing a relay with a core and an armature in accordance with the present invention.

As shown in FIG. 1, a relay in accordance with the present invention has a core which is identified by reference numeral 12 and supports a coil, and an armature.

The armature includes a stationary or immovable armature element which has two arm portions 10 and 11. Generally, the immovable armature element may be formed as an L-shaped sheet defining the above-mentioned arm portions 10 and 11. The core 12 with the coil of the relay is fixed on the arm portion 10 of the immovable armature element. The arm portion 11 extends substantially normal to the arm portion 10. The armature of the relay further has a movable armature element which is identified by reference numeral 13. Whereas the arm portion 10 of the stationary armature element is arranged at one axial side of the core 12, the movable armature element 13 is arranged at the opposite axial side of the same.

The arm portion 11 of the stationary armature element has a slot through which the movable armature element 13 extends at a level which is slightly above the axial end of the core 12. The slot of the arm portion 11 has an upper edge or projection having a trapeze-like cross-section with inclined flanks 15 and 16. The movable armature element 13 is, in turn, provided with a groove 14 which has two inclined flanks 25 and 26. The cross-section of the groove 14 in a plane of FIG. 1 is somewhat greater than the cross-section of the upper edge of the slot of the arm portion 11 of the stationary armature element in the same plane, as considered in direction of elongation of the movable armature element 13. More particularly, the angle formed between the inclined flanks 25 and 26 of the groove 14 of the movable armature element 13 is somewhat greater than the angle formed between the inclined flanks 15 and 16 of the upper edge of the arm portion 11 of the stationary armature element.

The movable armature element 13 is connected with the immovable armature element 10, 11 by a spring 17. The spring 17 has one end which is held in a notch 20 provided in an extension 18 of the arm portion 10 of the immovable armature, and the other end which is held in a notch 21 provided in an extension 19 of the movable armature 13. When the groove 14 and the upper edge of the arm portion 11 are designed as described hereinabove, the movable armature 13 can rock freely on the immovable armature element 10, 11 and be kept in contact with the latter under the action of the spring 17.

Figure 2:
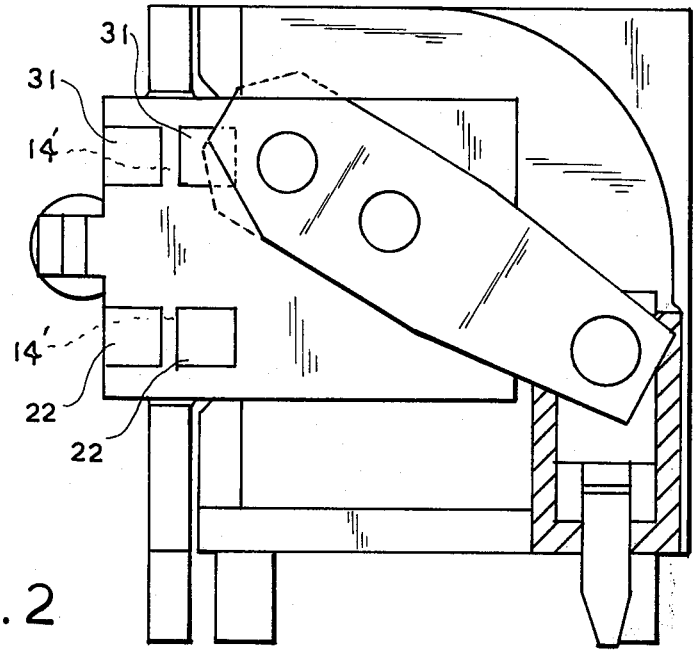
FIG. 2 is a plan view of the relay shown in FIG. 1, with some additional parts.
Figure 3:
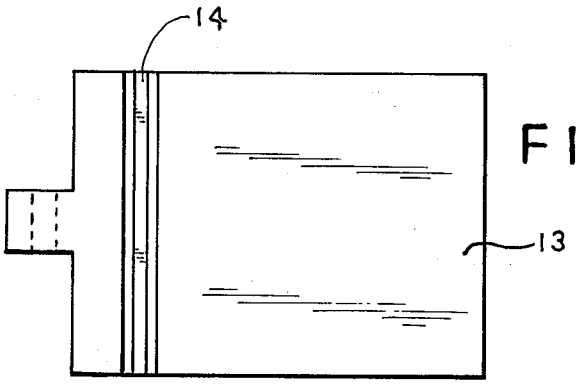
FIG. 3 is a plan view of a movable armature element in accordance with another embodiment of the invention.
Figure 4:
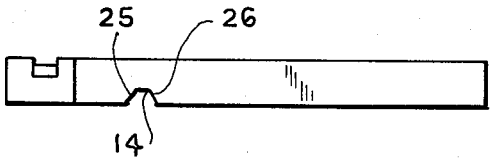
FIG. 4 is an elevation view of the movable armature element shown in FIG. 3.

The groove 14 may be formed in different ways. As shown in FIGS. 3 and 4, the groove 14 extends in direction of the width of the movable armature element 13 and is uninterrupted. In contrast, the groove in the movable armature element 13 shown in FIGS. 1 and 2 is formed in a different way. The movable armature element 13 has two pairs of depressions 31, 31 and 22, 22. The depressions of each pair are spaced from one another in direction of elongation of the movable armature element 13. The depressions 31, 31 and 22, 22 provide for some offset at four local points of the movable armature element 13 and form four protuberances facing toward the upper edge of the arm portion 11 of the stationary armature element 10, 11. Partial grooves 14' are thereby formed between each pair of the protuberances. Two partial grooves 14' together form a combined groove which extends and is interrupted in the direction of width of the movable armature element 13. It is understood that the depressions and thereby the protuberances are aligned with one another in the direction of width of the movable armature element 13.

The inclined flanks 15 and 16 of the upper edge of the slot of the arm portion 11 are connected with one another by a circular end section, thereby eliminating a sharp tip at the uppermost point of the upper edge of the slot of the arm portion 11. This further improves the condition of locking of the movable armature element 13 on the arm portion 11 of the movable armature element. The flanks 25 and 26 of the groove 14 in the movable armature element 13 may also be connected by a circular section which may substantially correspond to the circular end section of the upper edge of the slot in the arm portion 11. When the movable armature element rocks on the immovable armature element with the aid of the above-described joint formed therebetween, a higher performance and an improved operating condition of the relay are obtained. The joint is extremely simple and may be adapted to relays of the type which having a stationary armature of angular configuration, is particularly appropriate for mounting in printed circuits. It should also be borne in mind that in this type of joint the movable armature element is made to be disposed over the stationary armature element in such a way that in the movement thereof, the movable armature element is obliged to move, forming a positive angle on the one hand and a negative angle on the other hand, which aids and contributes notably with the good operation of the relay itself.

It will be understood that each of the elements described above, or two or more together, may also find a useful application in other types of constructions differing from the types described above.

While the invention has been illustrated and described as embodied in an armature for a relay, and a relay provided with such an armature, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An armature for a relay, comprising a stationary armature element having a first arm portion arranged to be fixedly connected to a core with a coil at one side of the latter, and a second arm portion extending substantially normal to said first arm portion; a movable armature element extending at the other axial side of the core with the coil and movable relative to said stationary armature element; and means forming a joint between said movable armature element and said stationary armature element, said joint forming means including a substantially trapeze-like projection formed on said second arm portion of said stationary armature element and having a predetermined cross section, and a groove formed in said movable armature element and having a cross section which is somewhat greater than the cross section of said trapeze-like projection, said cross section of said projection of said second arm portion of said stationary armature element having two inclined flanks forming a predetermined angle therebetween, said cross section of said groove of said movable armature element having two further inclined flanks defining therebetween a further angle which is somewhat greater than the angle between said flanks of said projection, said cross section of said projection of said second arm portion of said stationary armature having a circular end section connecting said inclined flanks with one another, said armature elements being arranged so that said projection and said groove cooperate with one another and thereby said movable armature element can perform a rocking movement relative to said stationary armature element.

2. An armature as defined in claim 1, wherein said stationary armature element has a portion provided with a peripherally closed slot having a wall which forms said projection with said flanks, said movable armature element having a portion provided with said groove with said further flanks and extending through said slot of said stationary armature so that said projection of said stationary armature cooperates with said groove of said movable armature within said slot.

3. An armature as defined in claim 1, wherein said movable armature element is elongated and has a predetermined width as considered in direction transverse to the direction of elongation of said movable armature element and to said cross section of said groove, said groove extending and being uninterrupted in direction of said width.

4. An armature as defined in claim 3, wherein said groove extends and is uninterrupted over the entire width of said movable armature element.

5. An armature as defined in claim 1, wherein said movable armature element is elongated and has at least two protuberances which face toward said projection of said second arm portion of said stationary armature and are spaced from one another in direction of elongation of said movable armature element so as to form said groove therebetween.

6. An armature as defined in claim 5, wherein each of said protuberances is formed by a depression which is arranged in said movable armature element at its side facing away from said projection and provides for offset of a local section of said movable armature element so as to form a respective one of said protuberances.

7. An armature as defined in claim 5, wherein said movable armature element has a predetermined width as considered in direction transverse to the direction of elongation of said movable armature element and to said cross section of said groove, said movable armature element having two pairs of such protuberances arranged so that each pair of protuberances forms one such groove, the pairs of protuberances are spaced from one another in direction of said width of said movable armature element so that the two grooves formed by said two pairs of protuberances together form a combined groove extending and interrupted in the direction of width of said movable armature element.

8. A relay, comprising a core with a coil having an axis; and an armature including a stationary armature element having a first arm portion arranged to be fixedly connected to a core with a coil at one axial side of the latter, and a second arm portion extending substantially normal to said first arm portion, a movable armature element extending at the other axial side of said core with said coil and movable relative to said stationary armature element, and means forming a joint between said movable armature element and said stationary armature element, said joint forming means including a substantially trapeze-like projection formed on said second arm portion of said stationary armature element and having a predetermined cross section, and a groove formed in said movable armature element and having a cross section which is somewhat greater than the cross section of said trapeze-like projection, said cross section of said projection of said second arm portion of said stationary armature element having two inclined flanks forming a predetermined angle therebetween, said cross section of said groove of said movable armature element having two further inclined flanks defining therebetween a further angle which is somewhat greater than the angle between said flanks of said projection, said cross section of said projection of said second arm portion of said stationary armature having a circular end section connecting said inclined flanks with one another, said armature elements being arranged so that said projection and said groove cooperate with one another and thereby said movable armature element can perform a rocking movement relative to said stationary armature element.

* * * * *